United States Patent [19]

Zbinden et al.

[11] 4,059,162

[45] Nov. 22, 1977

[54] DRILLING UNIT FOR STADIUM SEATS

[75] Inventors: James Zbinden; George W. Ries, both of Sterling, Ill.

[73] Assignee: Lawrence Brothers, Inc., Sterling, Ill.

[21] Appl. No.: 696,047

[22] Filed: June 14, 1976

[51] Int. Cl.[2] ..... E21C 9/00

[52] U.S. Cl. ..... 173/37; 173/42; 173/38; 173/52; 408/53

[58] Field of Search ..... 173/37, 38, 39, 42, 173/45, 52; 408/42, 51, 53, 98, 136

[56] References Cited

U.S. PATENT DOCUMENTS

| | | | |
|---|---|---|---|
| 965,024 | 7/1910 | Secrist | 173/37 |
| 1,968,892 | 8/1934 | Vonett et al. | 173/37 |
| 2,210,628 | 8/1940 | Mantini | 173/39 |
| 2,764,192 | 9/1956 | Poss | 173/42 |
| 2,788,194 | 4/1957 | Hale | 173/37 |
| 3,025,728 | 3/1962 | Cross et al. | 408/53 |
| 3,491,809 | 1/1970 | Schneider | 408/42 |
| 3,559,750 | 2/1971 | Mares | 173/45 |
| 3,718,404 | 2/1973 | Grinnell et al. | 408/53 |
| 3,749,507 | 7/1973 | Haley | 408/53 |
| 3,797,363 | 3/1974 | Noheul | 408/42 |

*Primary Examiner*—Robert A. Hafer

*Attorney, Agent, or Firm*—Olson, Trexler, Wolters, Bushnell & Fosse, Ltd.

[57] ABSTRACT

A drilling machine is disclosed for use in providing bolt holes in concrete stadium riser steps and the like. The drilling machine includes a relatively stationary base plate, and a foot plate slideable upon the base plate along a predetermined path. The foot plate carries drill mounting means for mounting a plurality of commercially available drills. An operating lever moves the foot plate, drill mounting device and drills toward and away from a vertical drilling face over the base plate.

17 Claims, 5 Drawing Figures

FIG. 1
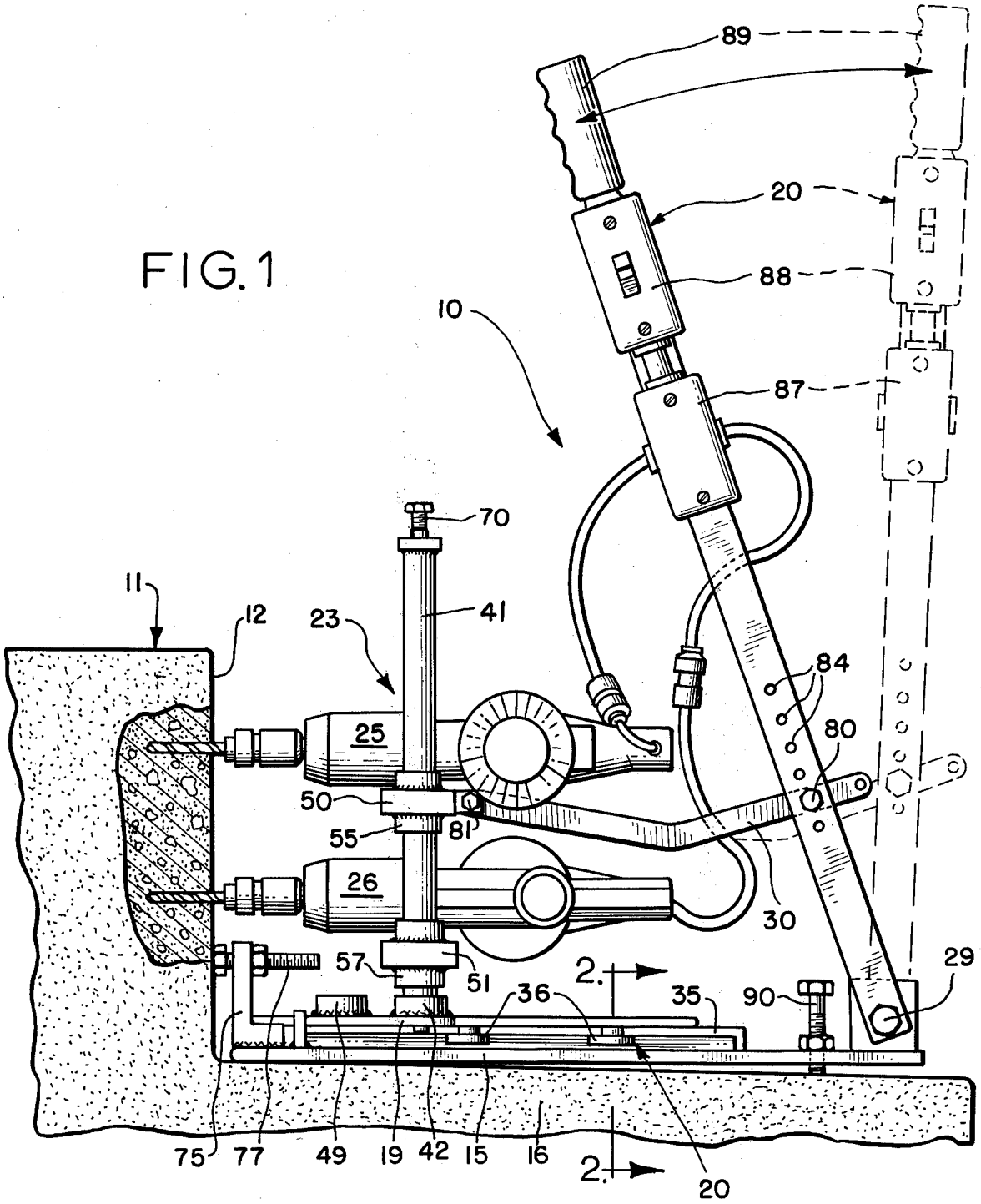
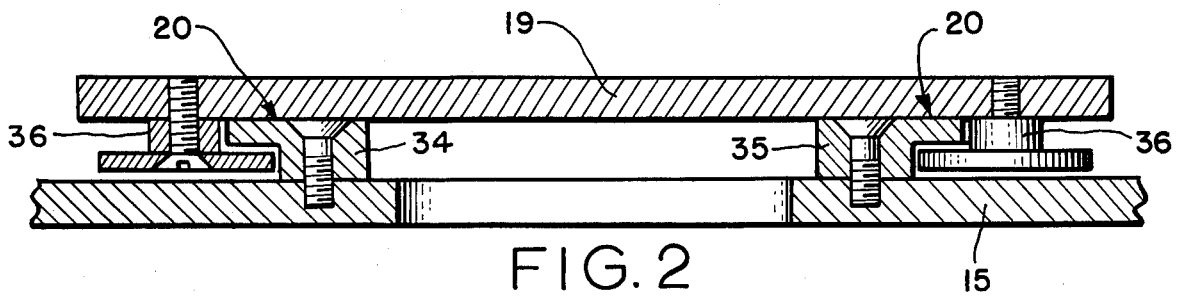
FIG. 2

FIG. 3
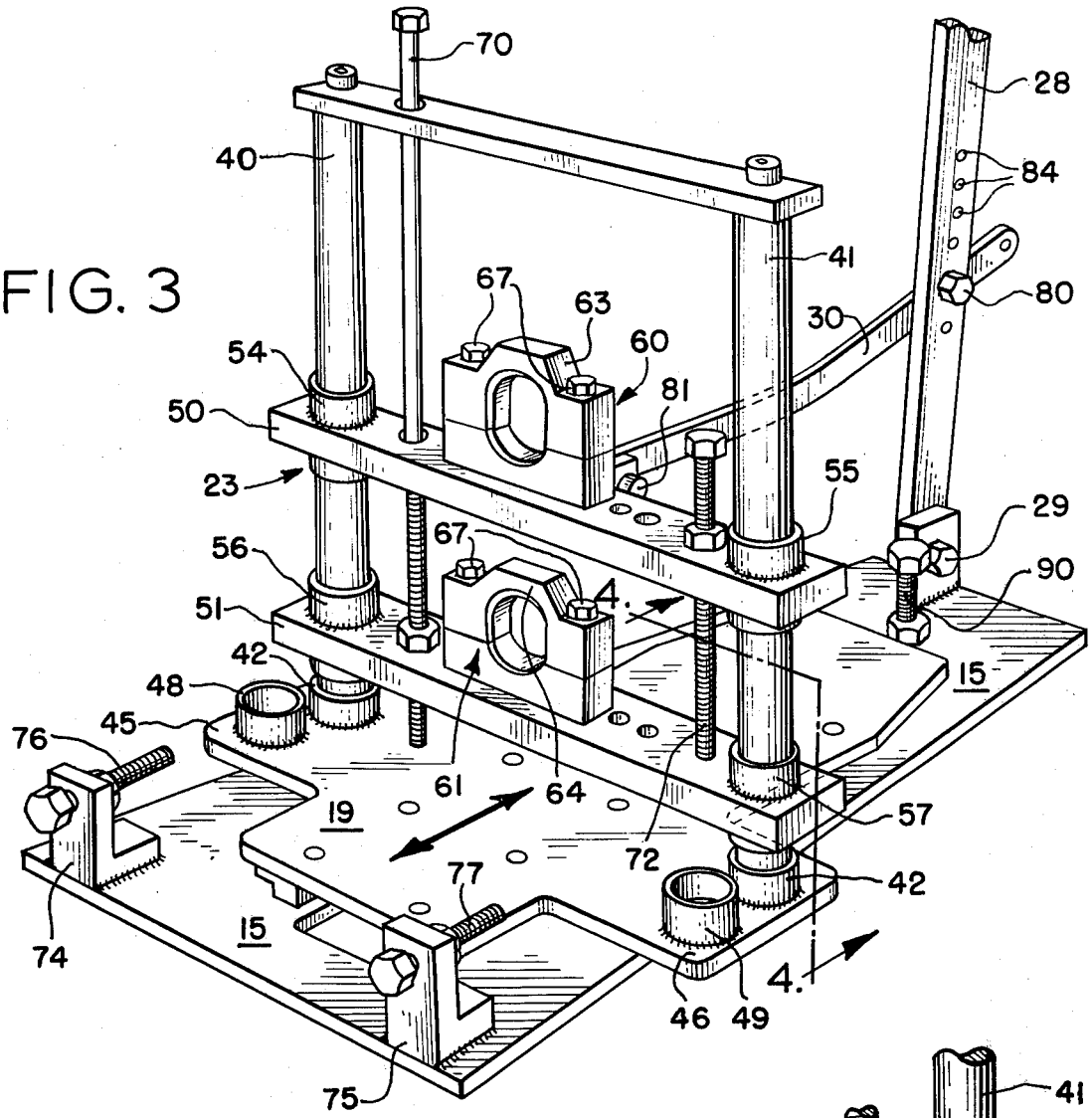
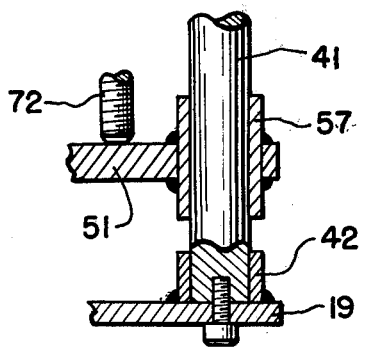
FIG. 4
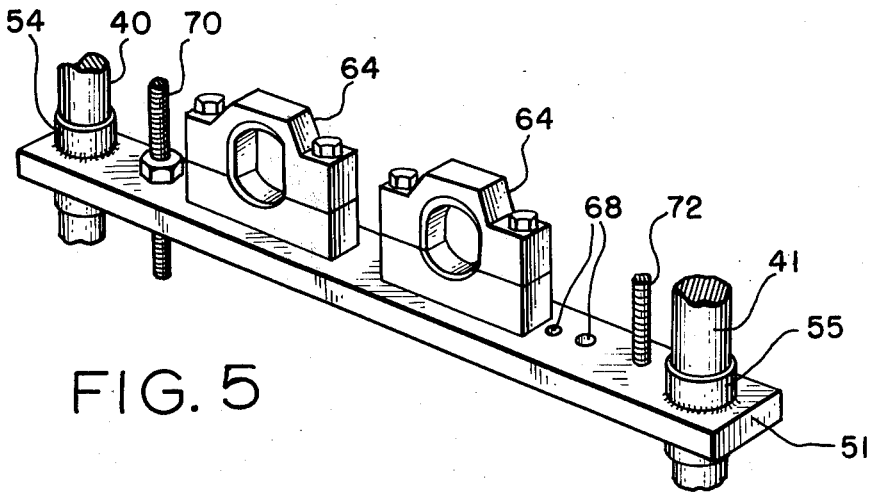
FIG. 5

DRILLING UNIT FOR STADIUM SEATS

BACKGROUND OF THE INVENTION

This invention relates generally to multiple drilling devices, and more particularly concerns concrete drilling machines for use in civil construction.

In constructing stadiums and like buildings, modern practice often calls for the construction of tiered cement steps and risers. At various locations along the steps and risers, individual seats or benches are mounted. These seats or benches are conveniently fixed in place by bolting them to the step or risers. To accommodate the seat bolts, holes must be drilled or otherwise formed in the concrete support structure.

Until now, drilling these holes in the support structure has been a difficult, tedious, and expensive task. If the construction project is a large one, many hundred or thousands of holes may be required. Each hole must be located precisely with respect to adjacent holes so as to accommodate the seat or bench bolt plate, and each hole must be oriented precisely with respect to the face in which the hole is drilled. In many cases, the drill operator must assume a kneeling position which causes great fatigue.

The general object of the present invention is to provide a drilling machine which will accommodate a plurality of drills so that the machine operator can easily drill a number of holes with reasonable accuracy. These holes are accurately formed both in angular relation to a known surface and in their depth in the vertical face of a concrete riser or a like structure. An associated general object is to provide such a drilling machine which can be constructed, sold and used at minimum expense.

A more specific object is to provide a machine which will accommodate and utilize standard power driven rotary or vibratory drills to minimize manufacturing and operating expenses and to maximize drilling effectiveness.

Another object is to provide such a machine which will drill a number of holes in a predetermined pattern, but which provides an adjustment for quickly changing the vertical elevation of that predetermined pattern.

Yet another object is to provide a drilling machine in which the operator can apply optimum drilling pressure simultaneously on all the drills for maximum drilling efficiency. A related object is to provide such a machine in which the operator can control the drilling operations from a standing position. Another related object is to provide such a device in which electrical power is delivered to all the drills simultaneously with but a single switch.

Still another object is to provide a drilling machine in which the drills can be oriented with relative precision at predetermined angles and locations with respect to the vertical face to be drilled, and into which the drills can be sunk to a precisely predetermined depth.

Other objects and advantages of the invention will become apparent upon reading the following detailed description, and upon reference to the drawings. Throughout the drawings, like reference numerals refer to like parts.

BRIEF DESCRIPTION OF THE DRAWINGS

FIG. 1 is a side elevation view showing the novel drilling unit as it appears in use;

FIG. 2 is a sectional view taken substantially in the plane of line 2—2 in FIG. 1;

FIG. 3 is a perspective view of the machine, the drills being removed for clarity;

FIG. 4 is a fragmentary sectional view taken substantially in the plane of line 4—4 in FIG. 3; and FIG. 5 is a fragmentary perspective view of an alternate embodiment of a lower drill mounting platform.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Turning first to FIG. 1 and 3 there is shown the novel drilling unit 10 of the present invention as it appears when being used during the construction of a stadium or the like. Here, a number of holes are being drilled in the riser portion 11 of a step-like concrete construction; The riser front is defined by a vertical face 12. To this face 12, stadium seats or benches will later be bolted. In general, the drilling machine 10 can be considered to include a relatively stationary base plate 15 adapted to rest atop a horizontal step surface 16 or the like. To this stationary base plate 15, a foot plate 19 is mounted by guide structure 20 for straight-line translational motion toward and away from the vertical face 12. A drill mounting mechanism 23 carries a number of drills 25 and 26 upon the foot plate 19 so that this foot plate 19, the mountings structure 23 and the drills 25 and 26 will all move together in fixed relation. This motion toward and away from the vertical face 12 is caused when the drilling machine operator moves a lever 28 which is pivoted to the base plate 15, as by a bolt 29. The lever is here attached to the sliding drill mount structure 23, by an interconnector lever 30. It will be noted that the guide structure 20 remains free from drilling dust and residue because the foot plate 19 covers the slides when the drills are operating in their drilling position.

To precisely guide the moveable foot plate 19 and the other structure affixed thereto along a translational path, stationary slides 34 and 35 are affixed to the base plate 15, and a number of spaced apart heads 26 are mounted upon the moveable foot 19. These slides and heads 34–36 control the motion of the foot plate 19 along the base plate 15 when the lever 28 is operated.

In accordance with the invention, the drills 25 and 26 can embody commercially offered rotary drills to minimize machine construction costs and maximize drilling efficiency. Further, these drills 25 and 26 are firmly mounted in desired locations upon the device, yet are precisely carried along desired paths of motion by the drill mountings structure 23. To this end, two upright standards 40 and 41 are carried in embossments 42 at either side of the machine. To maximize control of drill lateral motion and swaying, the standards 40 and 41 are set as far apart as possible, as by mounting them upon lateral foot plate extensions 45 and 46. Additional embossments 48 and 49 can be affixed to the foot plate 19 for carrying the standards 40 and 41 in alternate positions on the machine to permit a wider choice of variety of drill locations and drill actions.

A number of platforms 50 and 51 are slidably carried, as by collars 54–57 on the standards 40 and 41. The collars 54–57 permit the platforms 50 and 51 to be slid along the standards 40 and 41 into any one of a range of vertical positions. Each platform 50 and 51 is adapted to carry a commercially offered drill 25 or 26; this drill-platform attachment structure here takes the form of pillow blocks 60 and 61. Collars 63 and 64, respectively, secure the drills 25 and 26 to the pillow block 60 and 61 as by convenient bolts 67. As shown in FIG. 5, the platforms 50 and 51 can be sized to accommodate a number of drill mounting blocks 64. A number of additional bolt holes 68 can be provided to easily and quickly secure the blocks throughout a range of horizontal or lateral positions.

To precisely locate the platforms 50 and 51 and the carried drills 25 and 26 in the desired vertical locations, a primary vertical jack screw 70 threadably engages at least one of the platforms 51, and bears against the foot plate 19. It is a feature of the invention that by rotating the jack screw 70 (as by a wrench, crank, or other convenient device) the platforms 50 and 51 can be easily and quickly raised or lowered through the range of vertical positions relative to the foot plate 19 and other portions of the apparatus.

It is another feature of the invention that the vertical locations of the platforms 50 and 51 can be quickly and easily adjusted relative to one another, as well as relative to other portions of the apparatus. To this end, a secondary vertical jack screw 72 threadably engages one platform 50 and bears against the other platform 51. Again, rotation of this secondary vertical jack screw 72 will raise or lower the first platform 50 along the standards 40 and 41 in relation to the other platform 51.

In accordance with yet another aspect of the invention, the horizontal motion of the foot plate 19, drill mounting mechanism 23, and drills 25 and 26 themselves toward the vertical drilling face 12 can be halted at a precisely predetermined position. Further, the location of this predetermined horizontal motion stop position can be quickly and easily adjusted. To this end, extensions 74 and 75 project from the base plate 15, and horizontal jack screws 76 and 77 threadably engage the extension 74 and 75; the jack screws are positioned to bear against the vertical face 12 at positions, as shown in FIG. 1, above the horizontal step 16. By adjusting these screws 76 and 77, the depth of the holes to be drilled can be correspondingly altered. In addition, by adjusting one screw 76 or 77 relative to the other screw, the angular orientation of the machine 10 and carried drills 25 and 26 can be changed relative to the plane of the vertical face 12. Thus, holes can be drilled precisely perpendicularly to the face 12; altenatively, slightly off-normal angular orientation can be provided if construction techniques so require. Both the angular orientation and hole depth adjustements can be made quickly and easily by even inexperienced personnel. This extension and screw jack is precise and rugged, since it projects from the base plate 15 itself, and is inexpensive since it does not directly involve the drill mounting apparatus 23 itself. It is also located so as to avoid befoulment by debris fallout from the drills and drill holes, and is not affected by structure irregularities occuring at the face 12-step 16 intersection.

To move the drills 25 and 26 and drill mounting structure 23 toward and away from the vertical face 12, the operating lever 28 is pivoted to the base plate 15, and described above. The lever 28 is of extended length in accordance with one feature of the invention to permit the machine operator to perform drilling operations from a fatigue-minimizing standing position. The lever extent also decreases the force the operator himself must apply to perform the drilling operations satisfactorily.

The interconnector lever 30 is pivoted to the lever arm 28, as by a bolt 80, and the lever 30 is pivoted at its other end to the drill mounting structure 23, as by a bolt 81. A series of bolt-accepting holes 84 can be provided in the lever arm 28 to attach the interconnector lever 30 to the operating lever 28 at any one of a number of positions, thereby permitting the operator to apply greater or less drilling force against the vertical face 12 by a given impetus on the operating lever 28. In addition, the interconnector lever 30 applies the force from the operating lever 28 in the same direction as the direction of movement of the drill units for maximum efficiency.

In carrying out the invention, electrical power from a single remote source is delivered to each drill 25 and 26. Here, this distribution is accomplished through appropriate wiring lead to a distribution box 87. A drill-controlling off-on or drill speed switch 88 can be conveniently located near a lever handle 89. To adjust the entire device 10 toward and away from a horizontal orientation, an adjusting screw 90 threadably engages the base plate 15 and bears against the horizontal step 16.

The invention claimed is as follows:

1. A device for drilling a plurality of holes in a vertical face such as a stadium step riser, comprising, in combination, a base plate, drill mounting means including a movable foot plate, guide means interconnecting the base plate and foot plate to permit the foot plate to be slid over the base plate toward and away from the vertical face along a predetermined path, at least one upright standard, standard mounting means on the foot plate permitting the upright standard to be selectively affixed to and detached from the foot plate, a platform carried by the upright standard for linear vertical motion thereupon, means for affixing the platform relative to the standard in any one of a vertical range of positions, and means carried on the platform for selectively affixing to the platform a drill motor and carried drill, and lever means connected to the drill mounting means for urging the drill mounting means along the base plate toward the vertical face.

2. A device according to claim 1 wherein said guide means includes stationary slide means affixed to said base plate, and a plurality of spaced apart heads mounted upon said movable foot plate for engaging the stationary slide means to guide the movable foot plate along a predetermined path of translational motion relative to said foot plate.

3. A device according to claim 1 including a plurality of spaced apart standard mounting means for affixing said standard to said movable foot plate at any one of a number of positions.

4. A device according to claim 3 including standard mounting means comprising embossments affixed to said movable foot plate for carrying said standard and any one of a number of spaced apart positions on the foot plate.

5. A device according to claim 1 including a primary vertical location jack screw threadably engaging said platform and bearing against said foot plate, rotation of the primary vertical location jack screw raising or lowering the platform along the standard and relative to the foot plate.

6. A device according to claim 1 including a plurality of upright standards affixed to opposite lateral sides of said movable foot plate, and a plurality of platforms adapted to carry at least one drill and being retained upon the standards at any one of a range of vertical positions.

7. A device according to claim 6 including a primary vertical location jack screw threadably engaging at least one of the platforms and bearing against said foot plate, rotation of the jack screw raising or lowering the platforms along the standards and relative to the foot plate.

8. A device according to claim 7 including a secondary vertical location jack screw threadably engaging at least one platform and bearing against another platform, rotation of the secondary vertical jack screw raising or lowering the first platform along the standard and relative to the other platform.

9. A device according to claim 1 including means for halting the horizontal motion of the drill, drill mounting means, and movable foot plate toward the vertical face at a predetermined position relative to the base plate.

10. A device according to claim 9 wherein said means for halting horizontal motion includes a horizontal jack screw positioned to bear against a vertical drilling face.

11. A device according to claim 1 wherein said lever means comprises a lever pivoted to said base plate and an interconnector arm pivoted to the lever arm and to said drill mounting means for converting the rotational forward and reverse motion of the operation lever into translational forward and reverse motion of the drill mounting means.

12. A device according to claim 11 including adjustment means for pivotally attaching said interconnector arm to said operating lever at any one of a number of positions.

13. A device according to claim 1 including electrical distribution means for distributing electrical power from a single remote source to each of said drills.

14. A device for drilling a plurality of holes in a vertical face such as a stadium step riser, comprising, in combination, a base plate, a movable foot plate slideable over the base plate toward and away from the vertical face along a predetermined path, drill mounting means for mounting a plurality of drills for motion with the foot plate, the drill mounting means including a plurality of upright standards, standard mounting means affixed to the movable foot plate and permitting the standards to be selectively affixed to and detached from the foot plate, a plurality of platforms retained upon the standards, mounting means on each platform being adapted to mount on the platform at least one drill and drill driving motor, means for securing the platforms in any one of a range of desired vertical positions upon the standard and for adjusting the platforms with linear motion into desired vertical positions on the standard, and means for urging the drill mounting means along the base plate toward the and away from the vertical face.

15. A device according to claim 14 including means for halting the horizontal motion of the drill, drill mounting means and movable foot plate toward the vertical face at a predetermined position.

16. A device according to claim 15 including horizontal jack screw means adjustably secured to said base plate and adapted to engage a vertical drilling face for adjusting the maximum depth of holes drilled on the face and for adjusting the angular orientation of the holes relative to the face.

17. A device according to claim 14 including adjusting jack screw means threadably carried on said base plate for elevating or lowering one end of said base plate relative to a surface underlying the base plate.

* * * * *